US008813270B2

(12) United States Patent
Pizzi

(10) Patent No.: US 8,813,270 B2
(45) Date of Patent: Aug. 26, 2014

(54) HELMET WITH FLUSH ALIGNED SHIELD WHEN CLOSED

(76) Inventor: Vladimiro Pizzi, Camerata Cornello (IT)

( * ) Notice: Subject to any disclaimer, the term of this patent is extended or adjusted under 35 U.S.C. 154(b) by 0 days.

(21) Appl. No.: 13/559,501

(22) Filed: Jul. 26, 2012

(65) Prior Publication Data

US 2013/0191976 A1 Aug. 1, 2013

Related U.S. Application Data

(60) Provisional application No. 61/511,886, filed on Jul. 26, 2011.

(51) Int. Cl.

| | |
|---|---|
| ***A42B 3/04*** | (2006.01) |
| ***A42B 3/18*** | (2006.01) |
| *A42B 3/00* | (2006.01) |

(52) U.S. Cl.
USPC ..... 2/453; 2/451; 2/6.5; 2/425; 2/6.7; 2/8.3

(58) Field of Classification Search
USPC ..... 2/410, 6.1–6.8, 8.3, 422, 424, 425, 451, 2/453
See application file for complete search history.

(56) References Cited

U.S. PATENT DOCUMENTS

| | | | | |
|---|---|---|---|---|
| 3,792,702 | A * | 2/1974 | Delest | 128/207.11 |
| 4,247,960 | A * | 2/1981 | Nava | 2/424 |
| 4,359,207 | A * | 11/1982 | Maryonovich et al. | 254/272 |
| 4,581,776 | A * | 4/1986 | Kie | 2/425 |
| 4,584,721 | A * | 4/1986 | Yamamoto | 2/424 |
| 4,748,696 | A * | 6/1988 | Fohl | 2/424 |
| 5,084,918 | A * | 2/1992 | Breining et al. | 2/424 |
| 5,088,131 | A * | 2/1992 | Kamata | 2/424 |
| 5,570,881 | A * | 11/1996 | Lau | 463/47.1 |
| 5,604,930 | A * | 2/1997 | Petit et al. | 2/6.5 |
| 5,626,058 | A * | 5/1997 | Karpowich et al. | 74/489 |
| 5,765,914 | A * | 6/1998 | Britain et al. | 297/300.4 |
| 5,813,048 | A * | 9/1998 | Thom | 2/6.5 |
| 6,105,459 | A * | 8/2000 | Troiano | 74/542 |
| 6,442,766 | B1 * | 9/2002 | Arai | 2/422 |
| 7,757,309 | B2 * | 7/2010 | Schimpf | 2/424 |
| 2002/0073479 | A1 * | 6/2002 | Epperson et al. | 2/410 |
| 2004/0261158 | A1 * | 12/2004 | Depew et al. | 2/422 |
| 2005/0062327 | A1 * | 3/2005 | Griswold et al. | 297/378.1 |
| 2006/0161186 | A1 * | 7/2006 | Hassler et al. | 606/153 |
| 2006/0267351 | A1 * | 11/2006 | Spurr | 292/216 |
| 2007/0261153 | A1 * | 11/2007 | Wise et al. | 2/423 |
| 2008/0028501 | A1 * | 2/2008 | Schimpf | 2/424 |
| 2008/0072364 | A1 * | 3/2008 | Schimpf | 2/424 |
| 2008/0263752 | A1 * | 10/2008 | Solinsky et al. | 2/422 |
| 2009/0021067 | A1 * | 1/2009 | Griswold et al. | 297/378.13 |
| 2010/0068912 | A1 * | 3/2010 | Cole et al. | 439/352 |
| 2011/0046564 | A1 * | 2/2011 | Zhong | 604/198 |

(Continued)

*Primary Examiner* — Bobby Muromoto, Jr.
(74) *Attorney, Agent, or Firm* — Lowe Graham Jones PLLC

(57) ABSTRACT

A safety helmet includes a shield movable relative to a shell from an open to a closed position, and vice-versa through operation of a shield actuation system. When in the closed position, the shield actuation system permits the shield to be aligned substantially flush with the shell. Further, the shield actuation system allows the shield to be opened through a manual process that includes pushing on a lever or button to initially release the shield and then rotate the shield into the open position. The shield actuation system includes a number of plates with at least two of the plates in kinematic cooperation for allowing the shield to pop out and then rotate relative to the shell.

15 Claims, 14 Drawing Sheets

(56) References Cited

U.S. PATENT DOCUMENTS

2011/0145981 A1* 6/2011 Teetzel et al. ..... 2/422
2011/0203899 A1* 8/2011 Weifels ..... 192/219.5
2011/0239354 A1* 10/2011 Celona et al. ..... 2/422
2012/0246809 A1* 10/2012 Elam et al. ..... 2/424
2012/0291185 A1* 11/2012 Basson ..... 2/422
2012/0299313 A1* 11/2012 Organek et al. ..... 292/129
2013/0031699 A1* 2/2013 Gafforio et al. ..... 2/411

* cited by examiner

HELMET WITH FLUSH ALIGNED SHIELD WHEN CLOSED

PRIORITY CLAIM

This application claims the benefit of provisional application Ser. No. 61/511,886 filed Jul. 26, 2011, the contents of which are incorporated by reference.

FIELD OF THE INVENTION

This invention relates generally to a helmet having a shield or visor coupled to a shell, the shield being movable between a closed to an open position, wherein in the closed position an external surface of the shield is substantially flush with an adjacent surface of the shell.

BACKGROUND OF THE INVENTION

Conventional safety helmets, such a motorcycle or scooter helmets, may take a variety of forms, but generally include a shell and a visor or shield. Generally, such helmets include a full face guard in which the shell and face guard comprise a one-piece unit. The shield may be rotated to an open or closed position relative to the shell. While some shields are simply hinged with respect to the shell, others may have more complex rotational devices that permit the surface of the shield to be aligned substantially flush with the adjacent or proximate surfaces of the shell and face guard when the shield is in the closed position. Obtaining the substantially flush closure while striking a balance between weight and safety remain continual design issues for such helmets. Some of the helmets described in U.S. Pat. Nos. 4,581,776; 4,748,696; 5,088,131; and 6,442,766 describe various types of rotational devices that allow the shield to be aligned substantially flush when closed.

SUMMARY OF THE INVENTION

The present invention is generally related to a safety helmet, such as those commonly used for two-wheeled vehicles, all terrain vehicles or utility vehicles. The helmet includes a shield movable relative to a shell from an open to a closed position, and vice-versa through operation of a shield actuation system. When in the closed position, the shield actuation system permits the shield to be aligned substantially flush with the shell. Further, the shield actuation system allows the shield to be opened through an easy, manual process that includes pushing on a lever or button that initially releases (e.g., pops out) the shield, so the shield may be manually rotated into the open position.

In one example, a helmet includes a shell having an external shell surface and a shield having an external shield surface. The shield is movable from a closed position to an open position relative to the shell, and the shield surface is alignable substantially flush with the adjacent shell surface when the shield is in the closed position. This opening and closing of the shield is achieved through a shield actuation system. In one embodiment, the shield actuation system includes three plates: (1) an inner plate fixed to the shell; (2) an outer plate coupled to the shield; and (3) an intermediate plate located between the inner and outer plates. The intermediate plate is actuatable relative to the inner plate to move in a lateral direction. The outer plate kinematically cooperates with the intermediate plate such that the outer plate is rotatable along a desired path.

In yet another example, a method for opening and closing a shield of a helmet includes the steps of (1) manually moving a lever coupled to the helmet to provide tension in a cable, a proximal end of the cable coupled to the lever and a distal end of the cable coupled to a shield actuation system; (2) moving an outer plate of the shield actuation system in an outward and forward direction relative to a shell of the helmet, the outer plate affixed to the shield; and (3) rotating the outer plate along a path kinematically defined by an inner plate of the shield actuation system, the inner plate affixed to the shell.

BRIEF DESCRIPTION OF THE DRAWINGS

The sizes and relative positions of elements in the drawings or images may not necessarily be to scale, although in a preferred version of the invention the drawings represent a scale implementation. In other instances, for example, some elements may be arbitrarily enlarged or otherwise modified to improve clarity. Further, the illustrated shapes of the elements may not convey their actual shapes, and have been solely selected for ease of recognition. Various embodiments are briefly described with reference to the following drawings.

DETAILED DESCRIPTION OF THE INVENTION

In the following description, certain specific details are set forth in order to provide a thorough understanding of various embodiments of the invention. However, the invention may be practiced without these details or with various combinations of these details. In other instances, other structures and methods associated with safety helmets, shields and visors, shield actuation systems, and methods of assembling, operating and using them may not be shown or described in detail to avoid unnecessarily obscuring descriptions of the embodiments of the invention.

Figure 1:
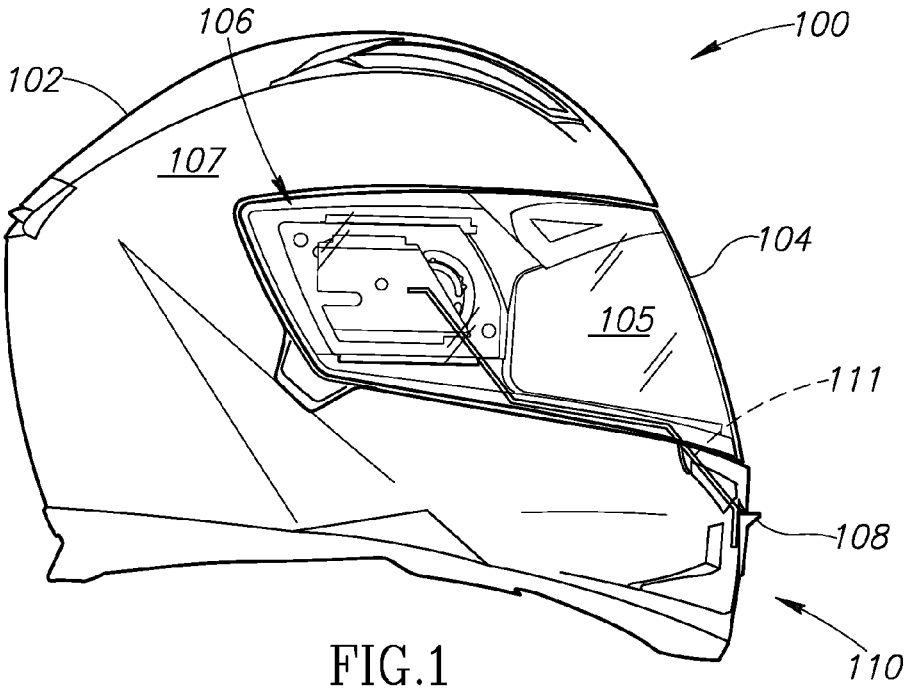
FIG. 1 is a side elevational view of a helmet having a shield in a closed position and where the shield is movable with a shield opening and closing system according to an embodiment of the present invention.
Figure 2:
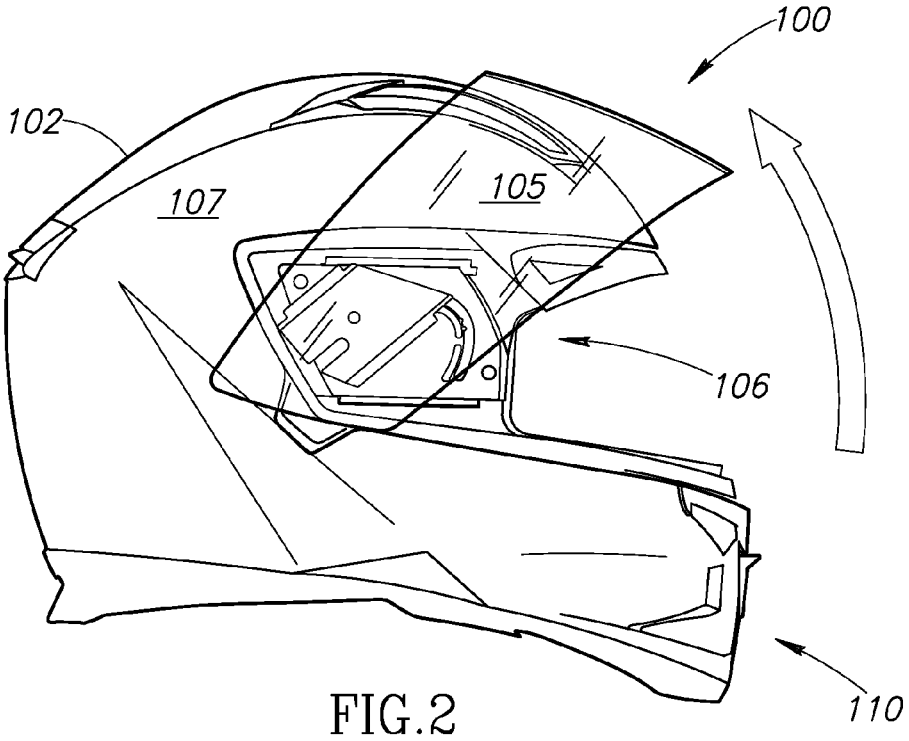
FIG. 2 is a side elevational view of the helmet of FIG. 1 with the shield in an open position according to an embodiment of the present invention.

FIGS. 1 and 2 show a helmet 100 having a shell 102 and a shield or visor 104 with the shield in a closed position (FIG. 1) and in an open position (FIG. 2), respectively. When in the closed position, an external surface 105 of the shield 104 aligns substantially flush with an external surface 107 of the shell 102. A shield opening and closing system 106 (hereinafter shield actuation system 106) provides the attachment means, kinematic guide means, and actuation means that allows the shield 104 to be manipulated from the closed to open position or vice-versa. The system 106 permits the shield 104 to "pop out" clear of the shell 102 before it is rotated into the open position, provides locking of the shield 104 while in the open position, and provides biasing devices that permit the shield 104 to be easily moved back to the closed position. When the shield 104 is in the open position, it may be moved to the closed position manually by a wearer or another person.

When in the closed position, the opening of the shield 104 may be manually initiated by pressing on tab or lever 108 located on a chin region 110 of the shell 102. The lever 108 is attached to a cable 111, which may be routed through an internal channel or passageway 113 (see FIG. 3) of the shell 102. The cable 111 extends from the lever 108 to the shield actuation system 106, such that movement of the lever 108 generates tension in the cable 111, which in turn actuates various components of the shield actuation system 106 as will be described in greater detail below. The lever 108 may take the form of a finger or thumb sized flange, knob or button, which may or may not have ridges.

Figure 3B:
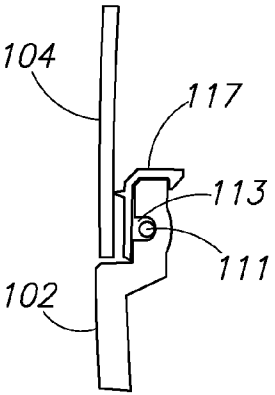
FIG. 3B is a cross-sectional view of a face guard portion of the helmet taken along line 3B-3B of FIG. 3A showing a location of the cable according to an embodiment of the present invention.
Figure 3A:
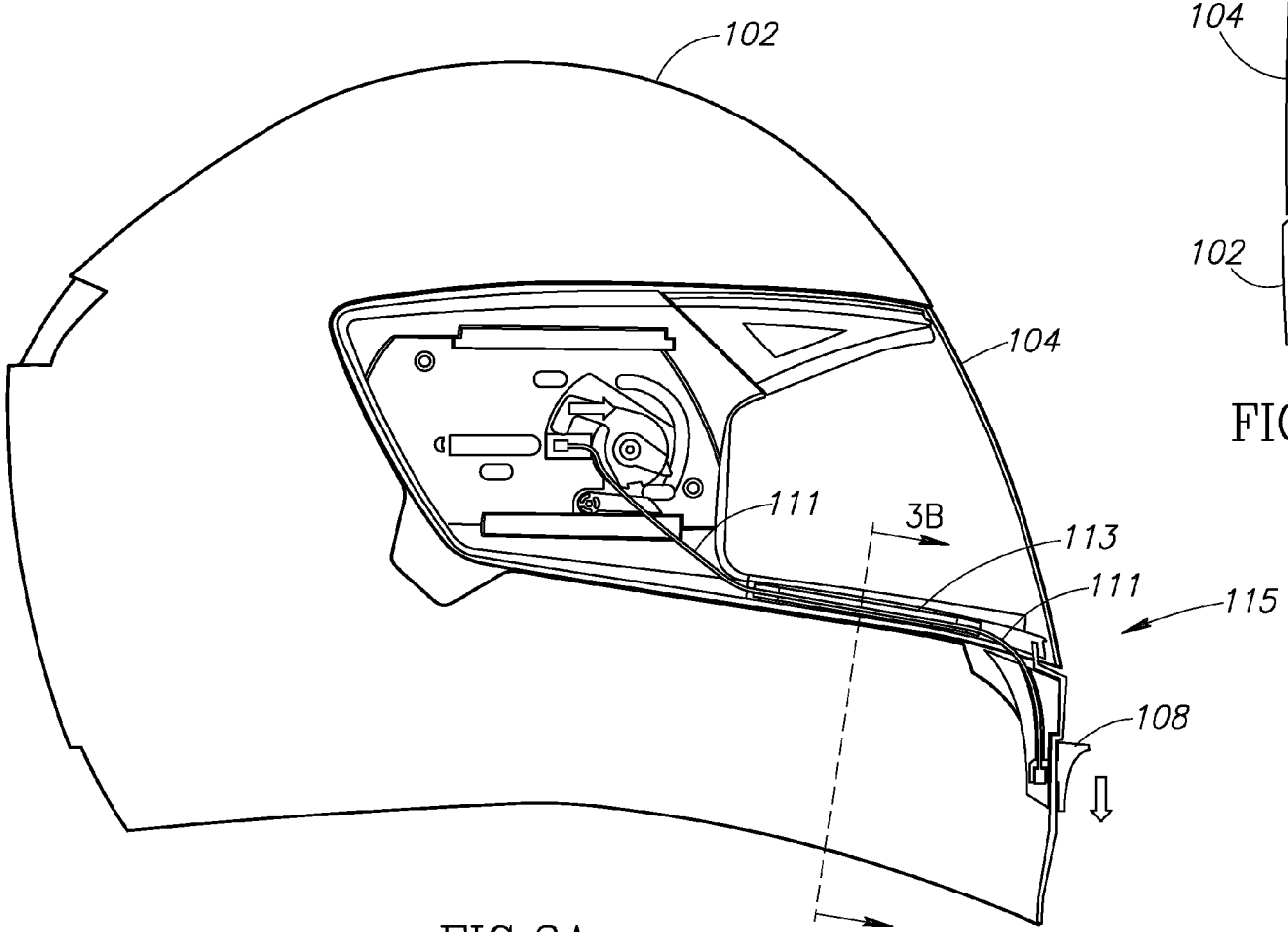
FIG. 3A is a side elevational view of the helmet of FIG. 1 showing actuation of the shield opening and closing system a finger-tab attached to a cable according to an embodiment of the present invention.

FIGS. 3A and 3B show side views of the helmet 100 with the shell 102 and shield 104. The cable 111 extends from the lever 108 through the channel 113 provided in a face guard portion 115 of the helmet. A cover 117 may provide closure of the channel 113 on one side while the shell provides closure of the channel 113 on the remaining sides.

Figure 4:
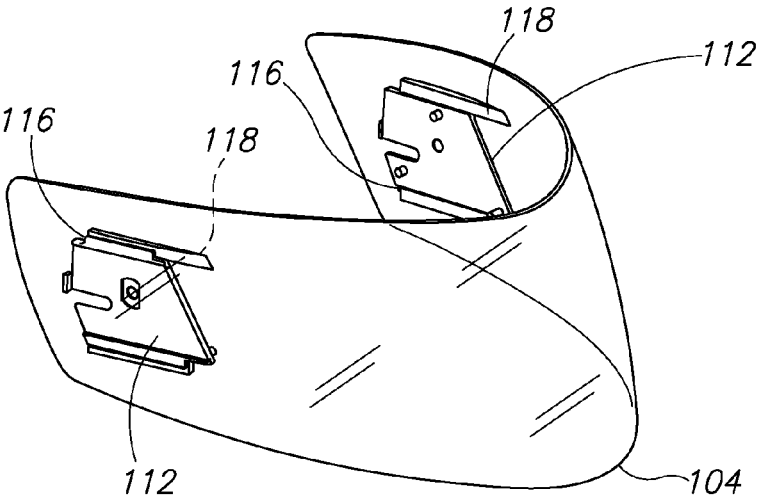
FIG. 4 is a perspective view of a shield for a helmet engaged with shield couplers according to an embodiment of the present invention.
Figure 5:
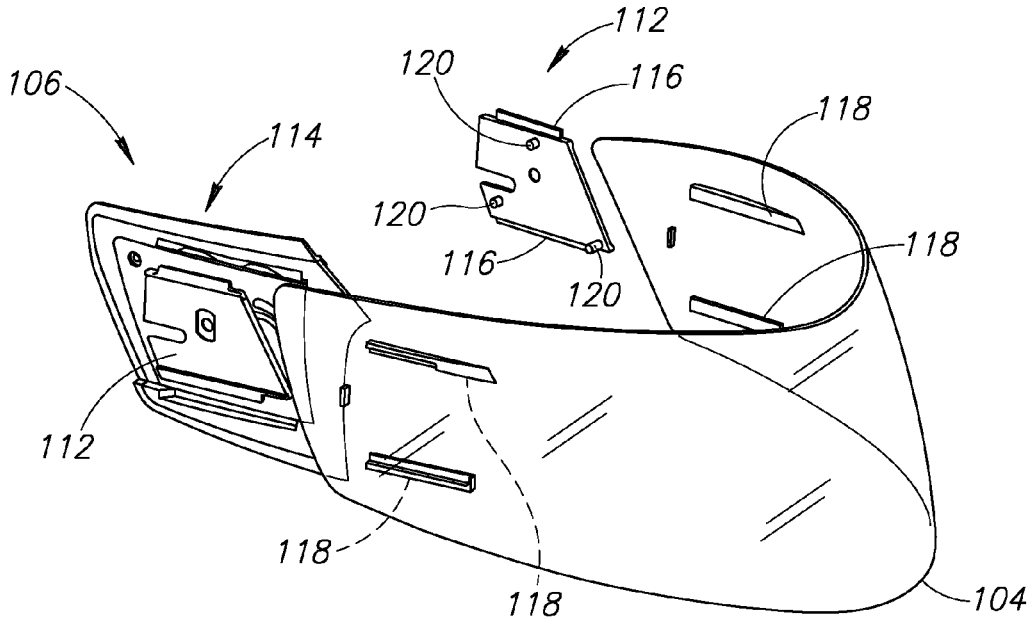
FIG. 5 is an exploded, perspective view of the shield of FIG. 4 engaged with an opening and closing system for the shield according to an embodiment of the present invention.

FIGS. 4 and 5 show how the shield actuation system 106 attaches to the shell 104 according to an example of the present invention. The shield actuation system 106 includes an outer plate 112 having upper and lower flanges 116 engageable with upper and lower tracks 118 of the shield 104, the latter of which may be integrally formed or molded with the shield 104. In one embodiment, the outer plate includes pins 120 that engage contoured slots of the shield actuation system 106. These pins 120 permit the outer plate 112, and in turn the shield 104, to be selectively manipulated (e.g., popped out and rotated) relative to the shell 102 of the helmet 100, which includes a predetermined, kinematic rotation of the outer plate 112 and includes a translational and lateral movement of the outer plate 112 relative to the shell 102. For purposes of the description herein, the term lateral includes a direction that is normal to or approximately normal to the outer surface 105 of the shield 104 in a sideways direction and the term lateral includes a direction that is approximately a fore-aft direction relative to the shell 102.

Figure 6:
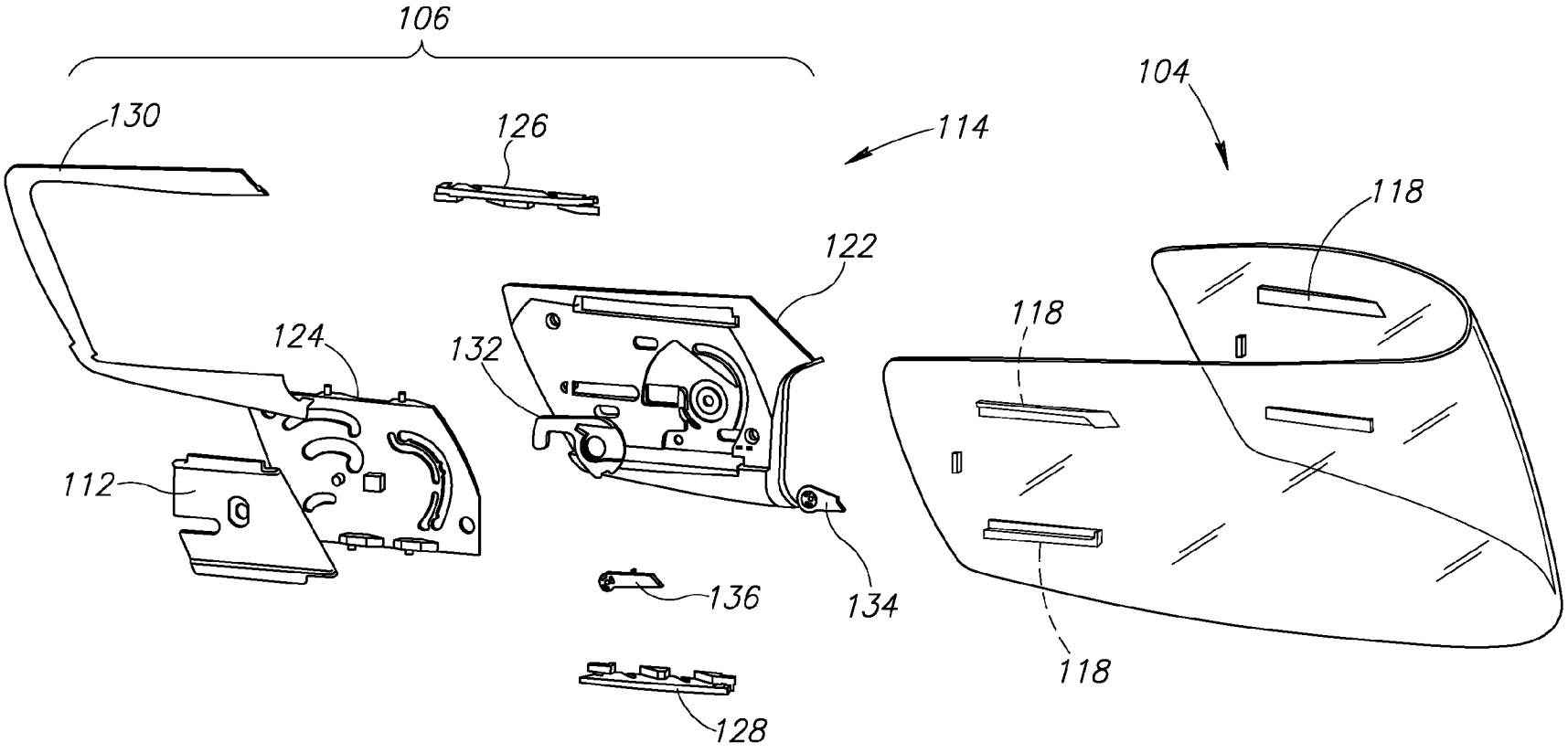
FIG. 6 is an exploded, perspective view of the shield and the shield opening and closing system of FIG. 5 according to an embodiment of the present invention.

FIG. 6 shows an exploded view of the shield actuation system 106 relative to the shield 104. The shield actuation system 106 includes the outer plate 112, as noted above, an inner plate 122, a guiding or intermediate plate 124, upper and lower guide members 126, 128, respectively, an optional gasket or seal 130, and a pawl and ratchet mechanism 131 that comprises a levered ratchet 132, a first pawl 134 and a second pawl 136 according to the illustrated embodiment.

In one embodiment, the shield actuation system 106 includes a structural and kinematic cooperation of three plates in which the inner plate 122 is fixed to the shell 102. The outer plate 112 is fixed to the shield 104, but is rotationally, translationally and laterally movable relative to the inner plate 122. The guiding plate 124 is located between the inner and outer plates and is translationally and laterally, but not rotationally, movable relative to the inner plate 122. The outer plate 112 kinematically cooperates with the guiding plate 124 such that it is rotatable along a desired path that preferably maintains the shield 104 close to the shell 102 during rotation to and from the open and closed positions.

Figure 7A:
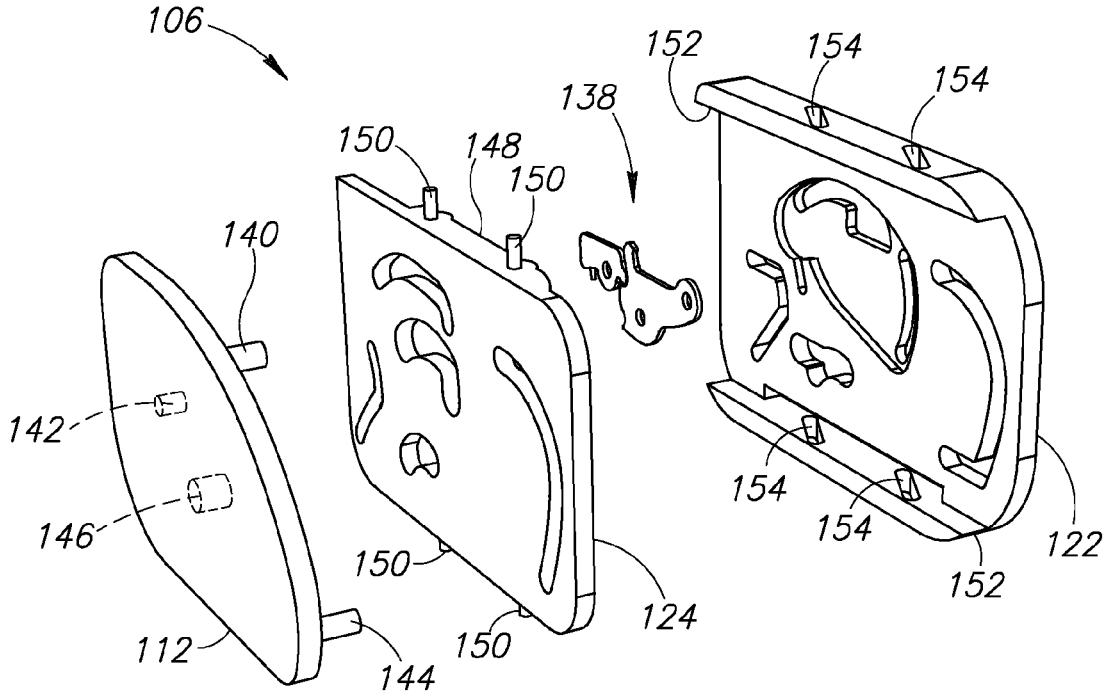
FIGS. 7A and 7B are exploded, perspective views of a shield actuation system according to an embodiment of the present invention.
Figure 7B:
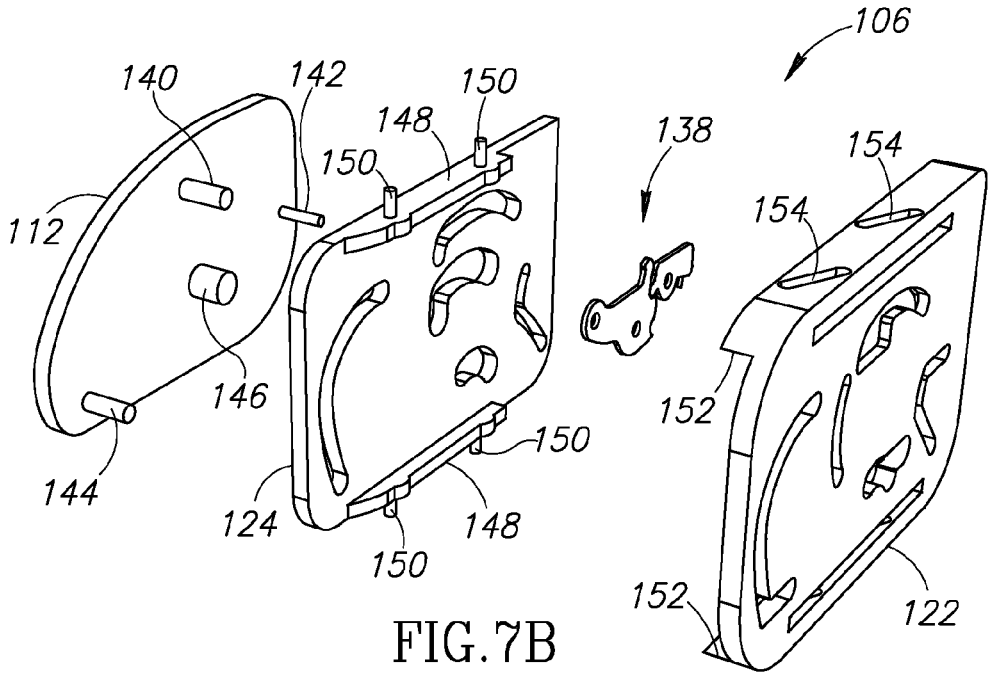

FIGS. 7A and 7B are exploded views of the plates 112 (outer), 124 (intermediate) and 122 (inner) along with another embodiment of a pawl and ratchet mechanism 138 for the shield actuation system 106 insertable in a right-hand side of the helmet 100. The shield actuation system 106 for the left-hand side of the helmet 100 would be a mirror image as compared to the right-hand side system. While many features of the plates 112, 122, and 124 and the pawl and ratchet mechanism 138 are described in the following drawings, there are some features that are identified in FIGS. 7A and 7B because such features are not easily discernible in the following drawings. For example, the outer plate 112 includes laterally directed pins identified as top pin 140, left pin 142, right pin 144 and central pin 146. The intermediate plate 124 includes flanges 148 that support vertically oriented pins 150. The inner plate 122 includes outstanding upper and lower flanges 152 with angled slots 154 formed therein, respectively. The angled slots 154 permit the shield 104 to be moved simultaneously outward and forward (i.e., both lateral directions with respect to the shield) to clear the shell 102. In one embodiment, the shield 104 "pops" clear of the shell 102 by about 3.0 millimeters on the sides and by about 5.5 millimeters in the front. A ratchet pin 155 may be coupled to the pawl and ratchet mechanism 138.

Figure 8:
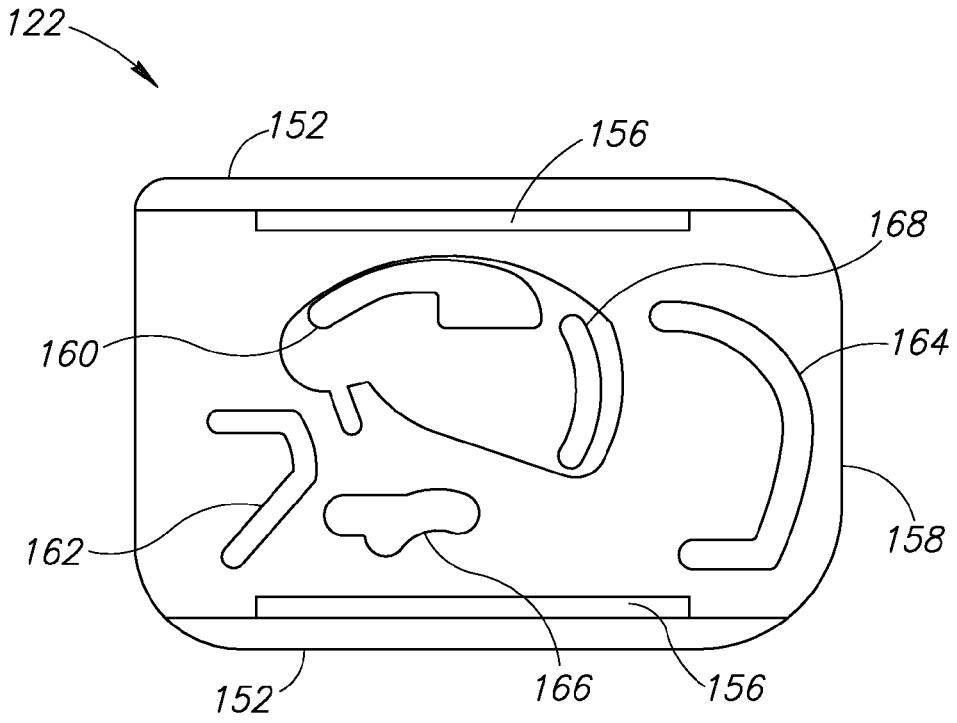
FIG. 8 is side elevational view of an inner plate of the shield actuation system of FIGS. 7A and 7B according to an embodiment of the present invention.

While still referring to FIGS. 7A and 7B, FIG. 8 shows the inner plate 122 with the outstanding flanges 152. The inner plate 122 includes upper and lower lengthwise slots 156 to receive the flanges 148 of the intermediate plate 122. An inner plate body 158 includes a plurality of shaped or contoured slots, which operate to kinematically define and restrain movement of the intermediate plate 124, the outer plate 112 and the pawl and ratchet mechanism 138. While the illustrated embodiment shows each slot having a particular shape, it is appreciated that any of the slots may take other shapes and still operate to kinematically define and restrain the mating components. Because the slots cooperate with the pins of the outer plate 112, the slots are identified as top-inner slot 160, left-inner slot 162, right-inner slot 164, and central-inner slot 166. In addition, a ratchet pin slot 168 is located proximate the top inner slot 160 and the ratchet pin slot 168 operates to receive the ratchet pin 155 extending from the pawl and ratchet mechanism 138.

Figure 9:
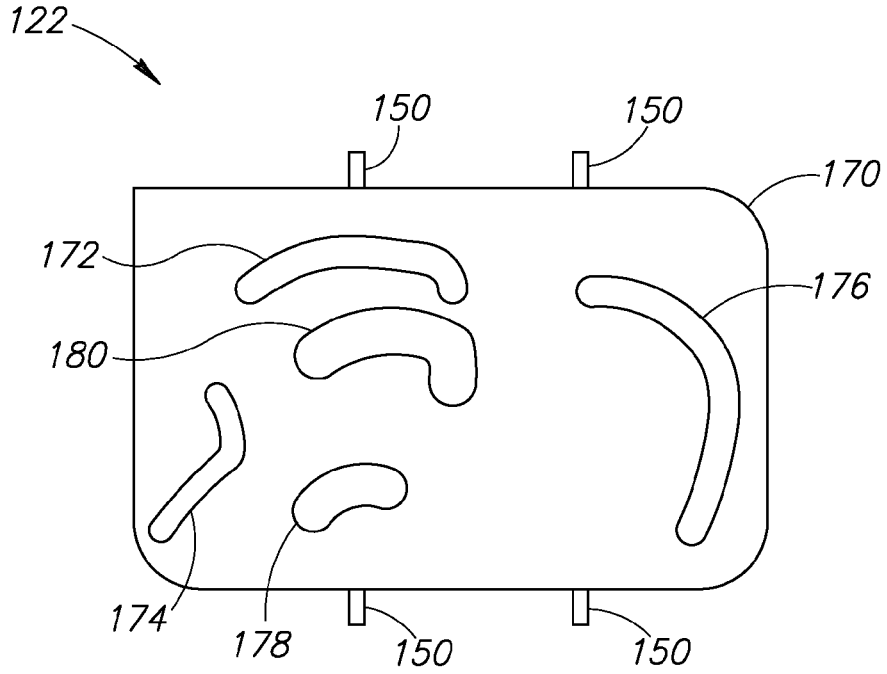
FIG. 9 is side elevational view of an intermediate plate of the shield actuation system of FIGS. 7A and 7B according to an embodiment of the present invention.

Now still referring to FIGS. 7A and 7B, FIG. 9 shows the intermediate plate 124 having the vertically oriented pins 150 extending from an intermediate plate body 170. Like the inner plate 122 described above, the intermediate plate 124 includes a plurality of slots that operate to kinematically define and restrain movement of the outer plate 112 and the pawl and ratchet mechanism 138. While the illustrated embodiment shows each slot having a particular shape, it is appreciated that any of the slots may take other shapes. The slots for the intermediate plate 124 are identified as a top-intermediate slot 172, a left-intermediate slot 174, a right-intermediate slot 176, a central-intermediate slot 178 and a pawl-n-ratchet slot 180.

Figure 10:
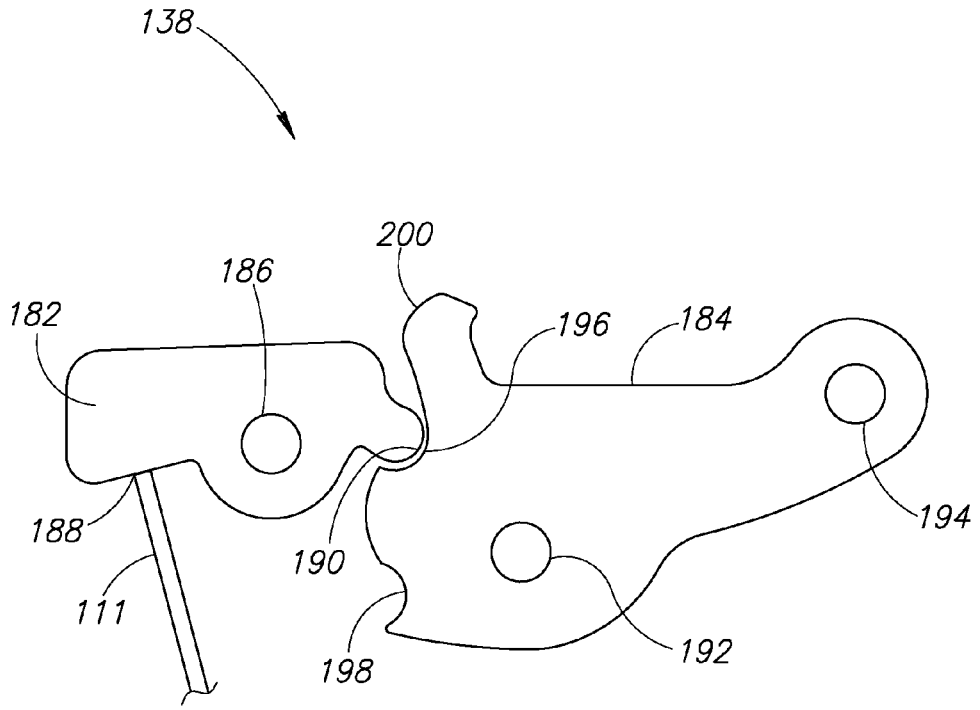
FIG. 10 is side elevational view of pawl and ratchet mechanism of the shield actuation system of FIGS. 7A and 7B according to an embodiment of the present invention

FIG. 10 shows the pawl and ratchet mechanism 138 and includes a pawl member 182 and a ratchet member 184. The terms pawl and ratchet are meant to be broadly interpreted because a pawl is commonly understood to have a finger that engages one or more teeth of a ratchet and thus control a linear or rotational motion of the ratchet. The pawl member 182 is coupled to the cable 111, such that tension in the cable 111 actuates the pawl member 182. The pawl member 182 includes a pawl pivot point 186 that acts as a fulcrum and is located between the cable attachment point 188, which may take the form of a protruding pawl pin (see pawl pin 188 in FIG. 11) and a pawl finger 190.

The ratchet member 184 includes a ratchet pivot point 192 and a ratchet guide aperture 194 that receives the ratchet pin 155. In addition, the ratchet member 184 includes an upper finger notch 196 and a lower finger notch 198. Lastly, the ratchet member 184 includes a top-pin driver 200.

Figure 11:
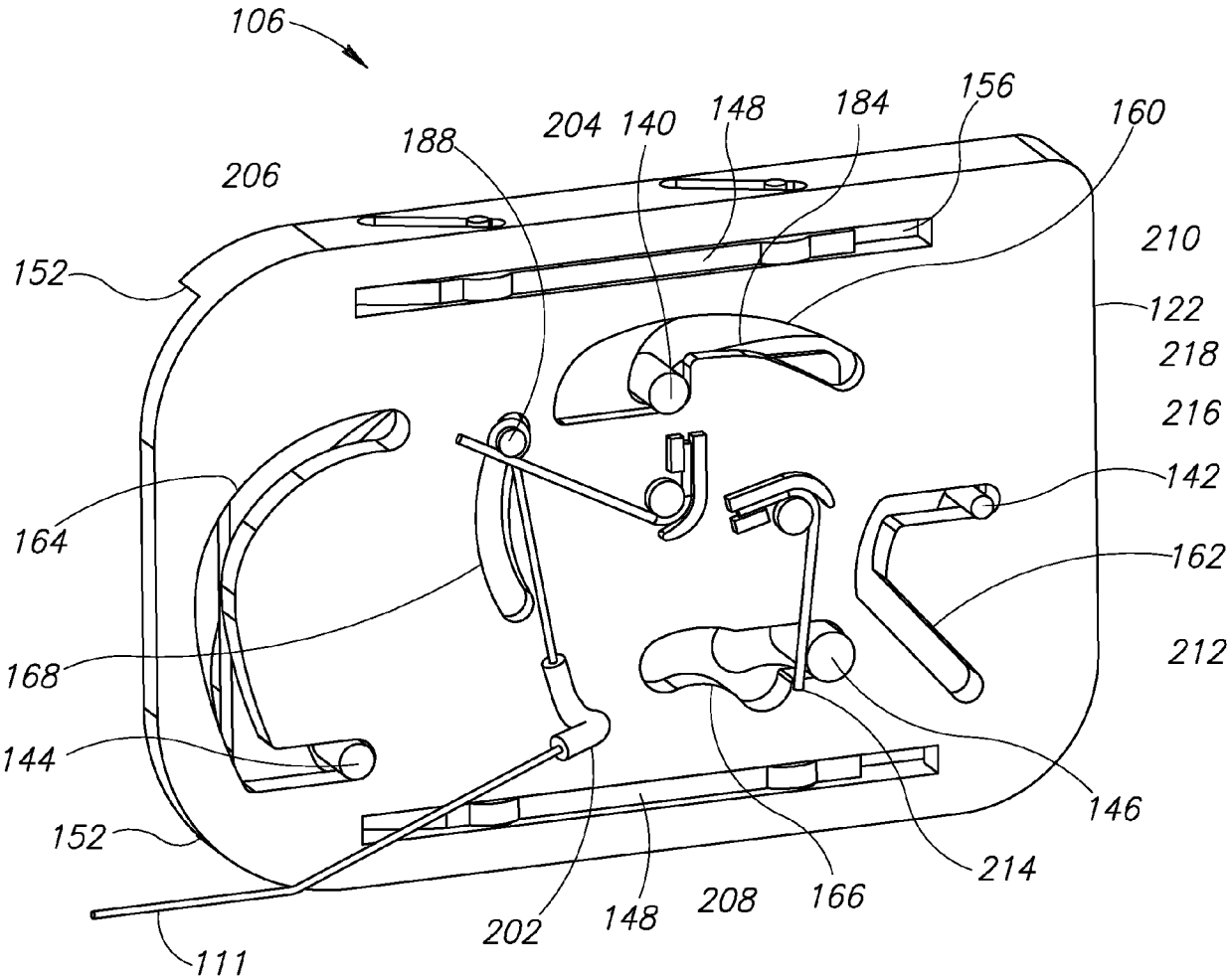
FIG. 11 is a perspective view of a shield actuation system having biasing members coupled to an inner plate according to an embodiment of the present invention.

FIG. 11 shows the shield actuation system 106 and more specifically shows various biasing devices interacting with various pins. Some, but not all, reference numerals defined above are carried over in the illustrated embodiment for ease of reference between the various drawings. In the illustrated embodiment, the cable 111 is routed through a cable guide 202 and attaches to pawl pin 188. The cable guide 202 may be configured to sufficiently change a direction of the cable 111, by about ninety degrees for example. The shield actuation system 106 includes a pawl biasing member 204 having a first end portion 206 engaged with the pawl pin 188 and a second end portion 208 secured by first retaining structure 210. The shield actuation system 106 further includes a central-pin biasing member 212 having a first end portion 214 engaged with the central pin 146 and a second end portion 216 secured by second retaining structure 218. While the biasing members 204, 212 take the form of cantilevered biasing members, it is appreciated that the biasing members 204, 214 may take other forms, such as compression springs, extension springs, torsion springs and other types of resilient mechanisms capable of providing the desired biasing forces.

Figure 12A:
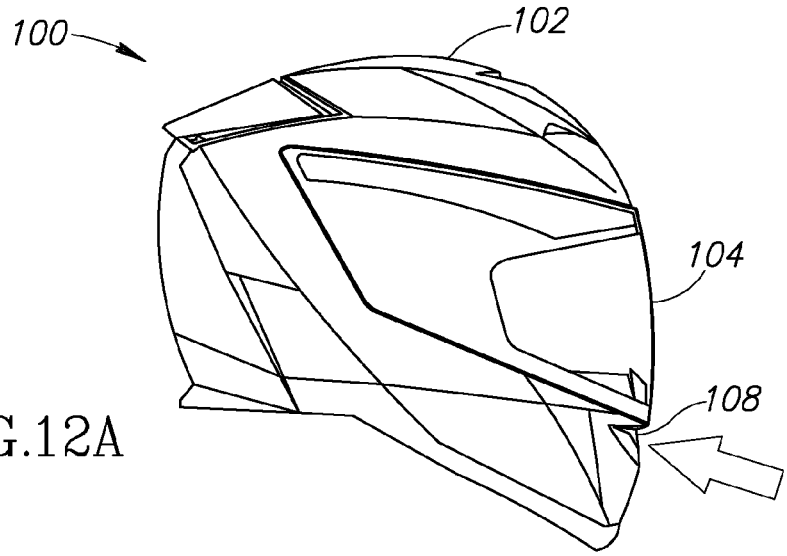
FIGS. 12A-12C are side elevational views of a shield movable relative to the helmet in accordance with a shield actuation system of the present invention.
Figure 12B:
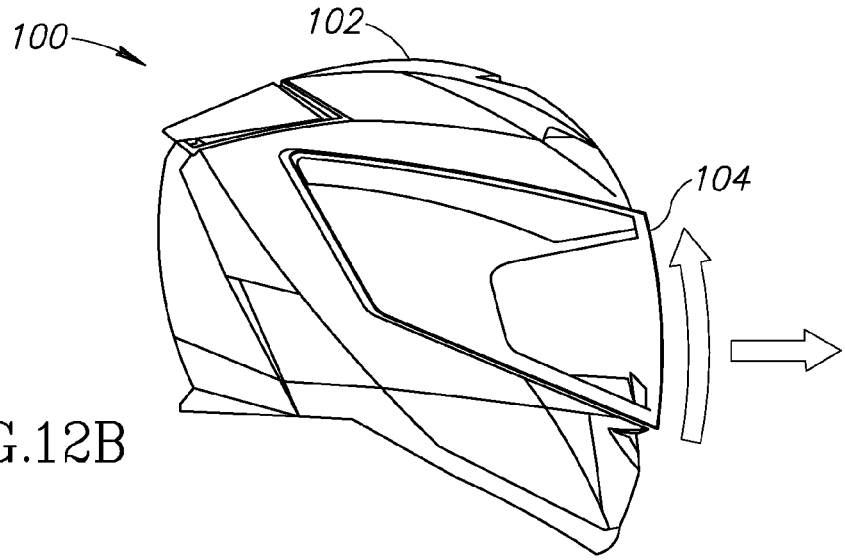
Figure 12C:
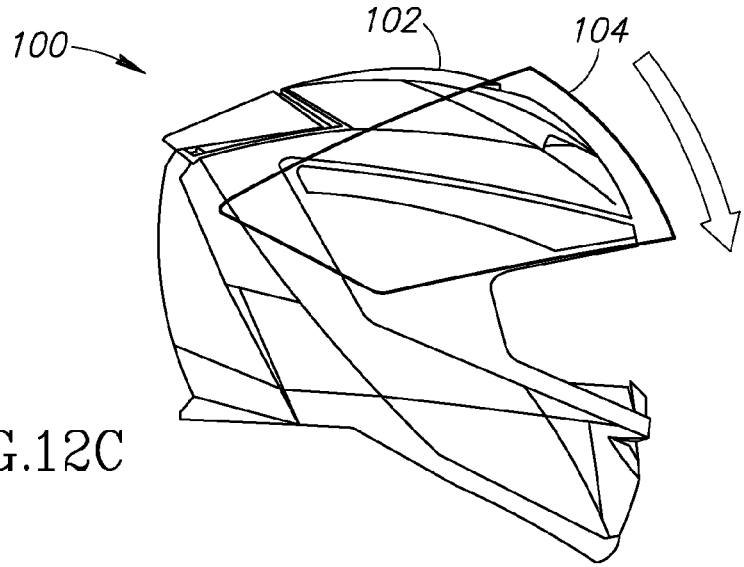
Figure 13A:
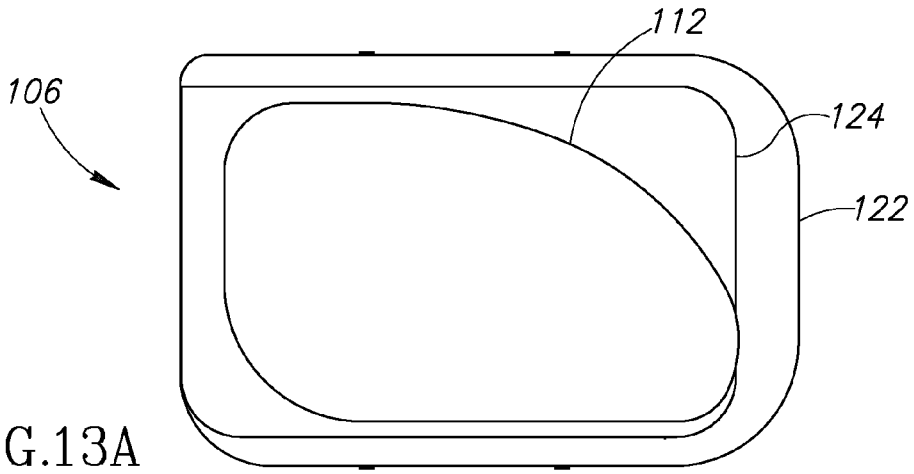
FIGS. 13A-13C are side elevational, schematic views showing the respective movements of the outer and intermediate plates of a shield actuation system according to an embodiment of the present invention.
Figure 13B:
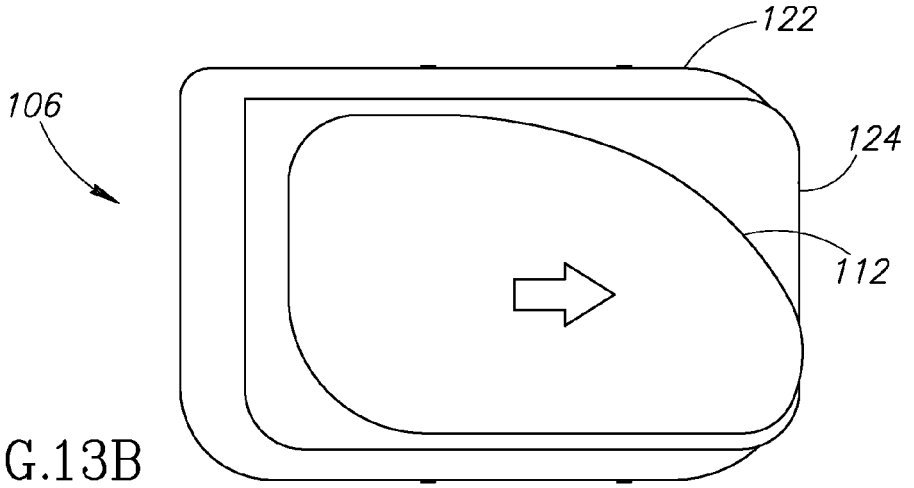
Figure 13C:
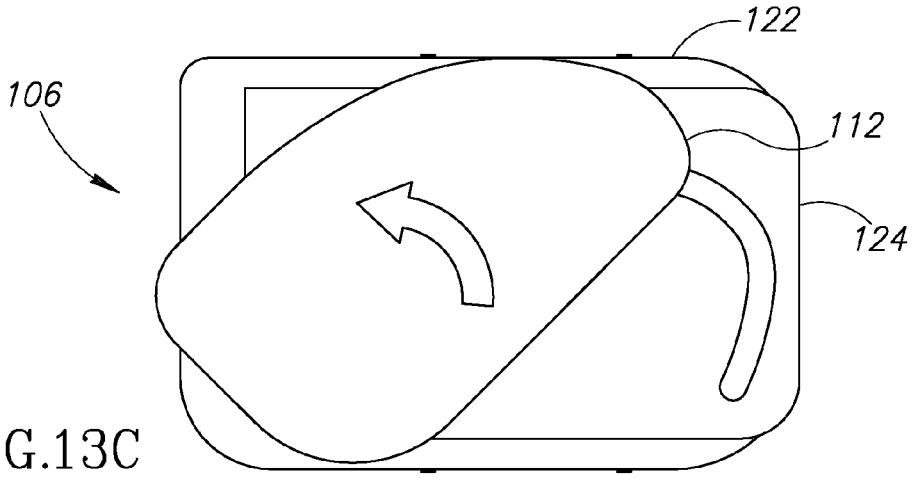
Figure 14A:
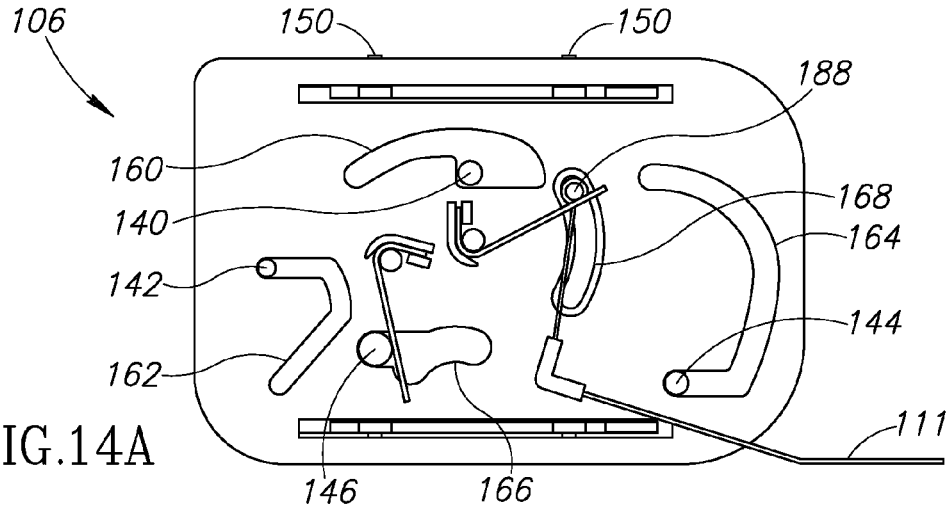
FIGS. 14A-14C are side elevational views of an inner plate of a shield actuation system showing movement of various pins within corresponding contoured slots according to an embodiment of the present invention.
Figure 14B:
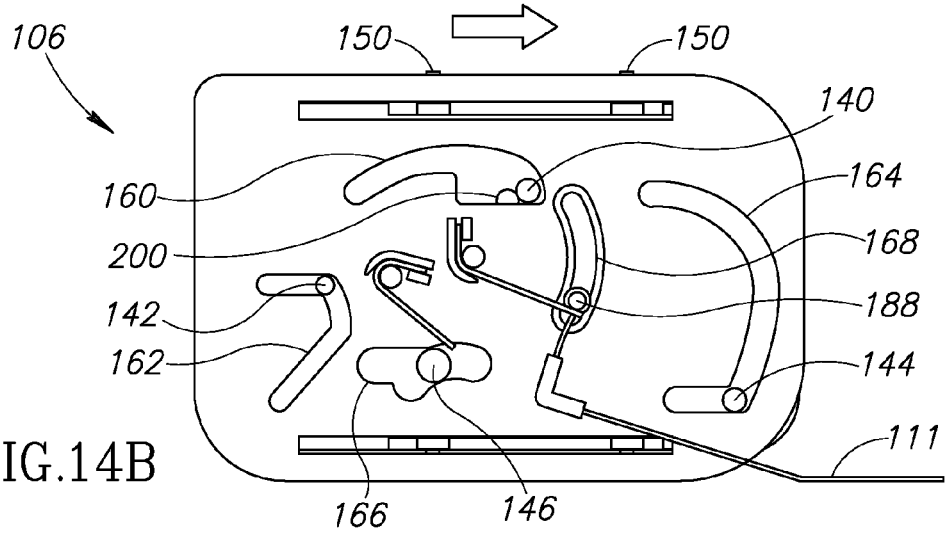
Figure 14C:
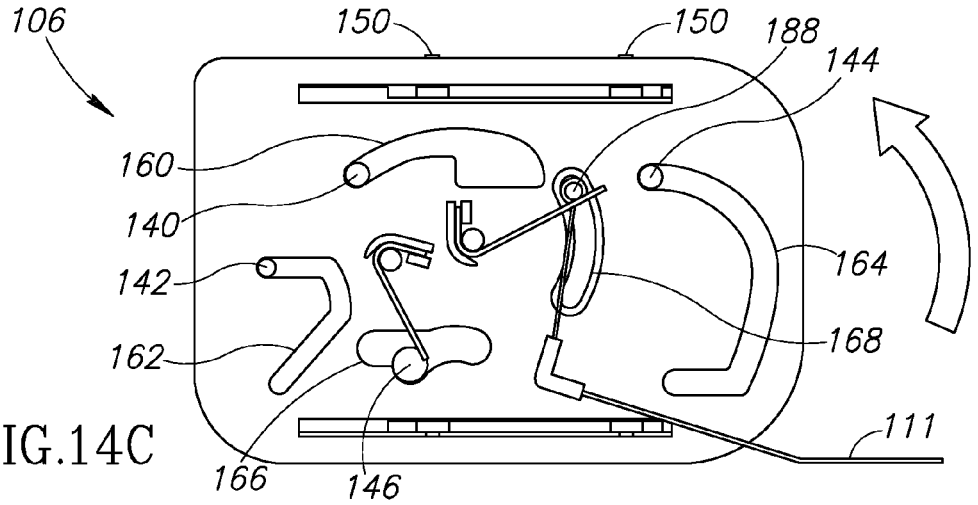
Figure 15A:
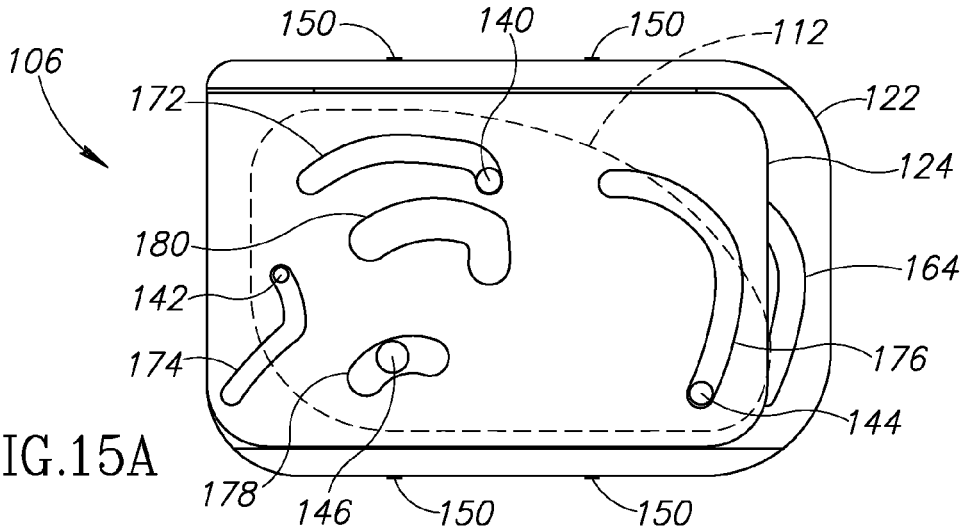
FIGS. 15A-15C are side elevational views of showing relative movement of the various plates in conjunction with various kinematic paths of a shield actuation system according to an embodiment of the present invention.
Figure 15B:
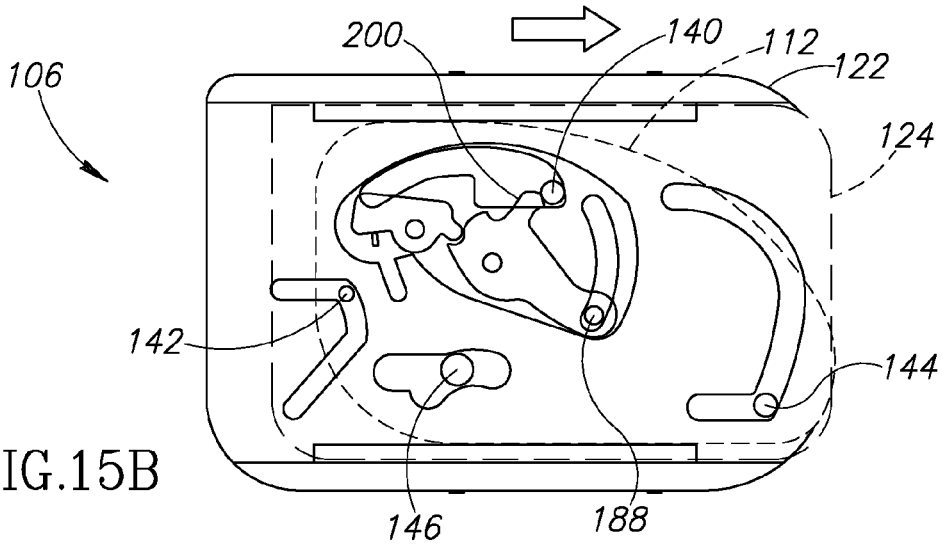
Figure 15C:
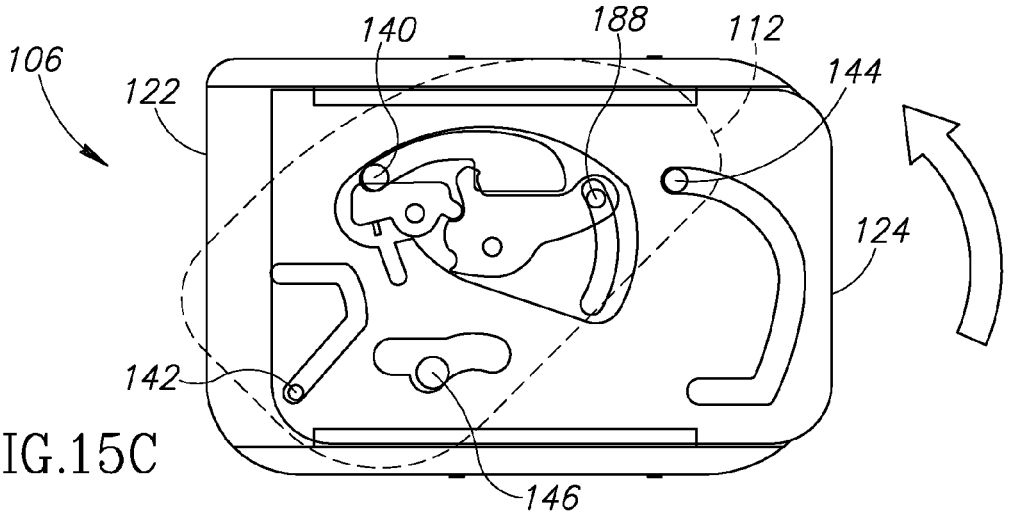
Figure 16A:
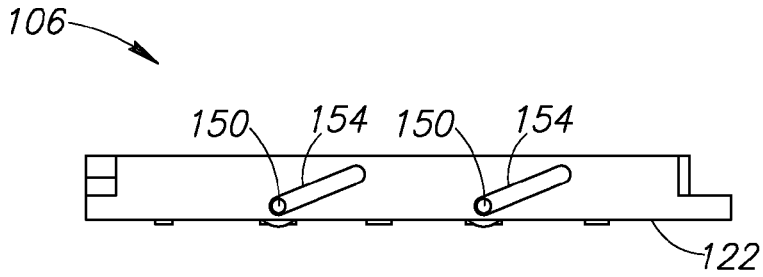
FIGS. 16A-16C are bottom plan views of a shield actuation system showing forward movement of an intermediate plate and showing a combined forward and outward movement of an outer plate of the shield actuation system according to an embodiment of the present invention.
Figure 16B:
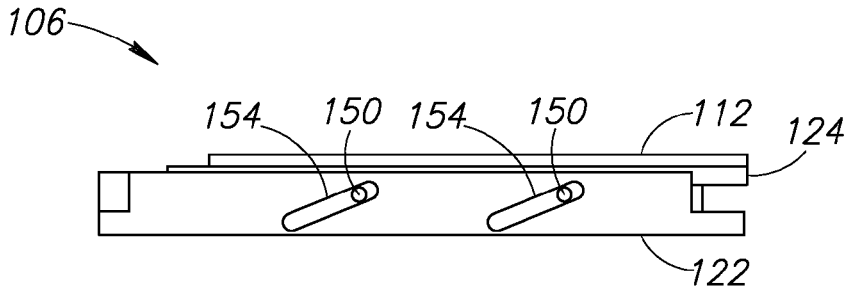
Figure 16C:
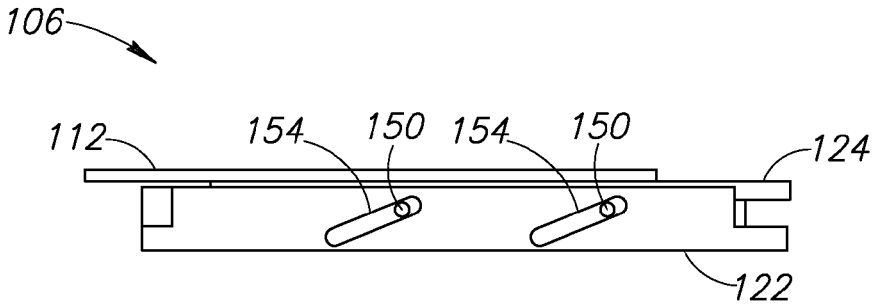

For purposes of clarity and to prevent overcrowding of the figures with reference numerals, continued reference to FIGS. 1-11 may be helpful in following the mechanical actuation process of the shield actuation system 106. The operation of the shield actuation system 106 is illustrated by the following sets of figures, which illustrate the movements of shield actuation system 106 as the shield 104 is moved from the closed position to the open position. The sets of figures, are as follows: FIGS. 12A-C (showing movement of the shield 104 relative to the helmet 100); FIGS. 13A-C (showing movement of the outer plate 112 relative to both the intermediate plate 124 and the inner plate 122 and also showing movement of the intermediate plate 124 relative to the inner plate 122), FIGS. 14A-C (showing movement of the pawl and ratchet mechanism 138 and the various pins relative to the inner plate 122); FIGS. 15A-C (showing movement of the pawl and ratchet mechanism 138 and the various pins relative to each plate 112, 122 and 124); and FIGS. 16A-C (showing movement of the intermediate plate 124 as constrained by angled slots 154 of the inner plate 122).

Each of the aforementioned figures with an "A" designator illustrates an aspect of the actuation system 106 when the shield 104 is in the closed position. Each of the aforementioned figures with a "B" designator illustrates an aspect of the actuation system 106 when the shield 104 has been initially popped out relative to the shell 102 of the helmet 100. Likewise, each of the aforementioned figures with a "C" designator illustrates an aspect of the actuation system 106 when the shield 104 has been rotated into the open position.

Figure 17:
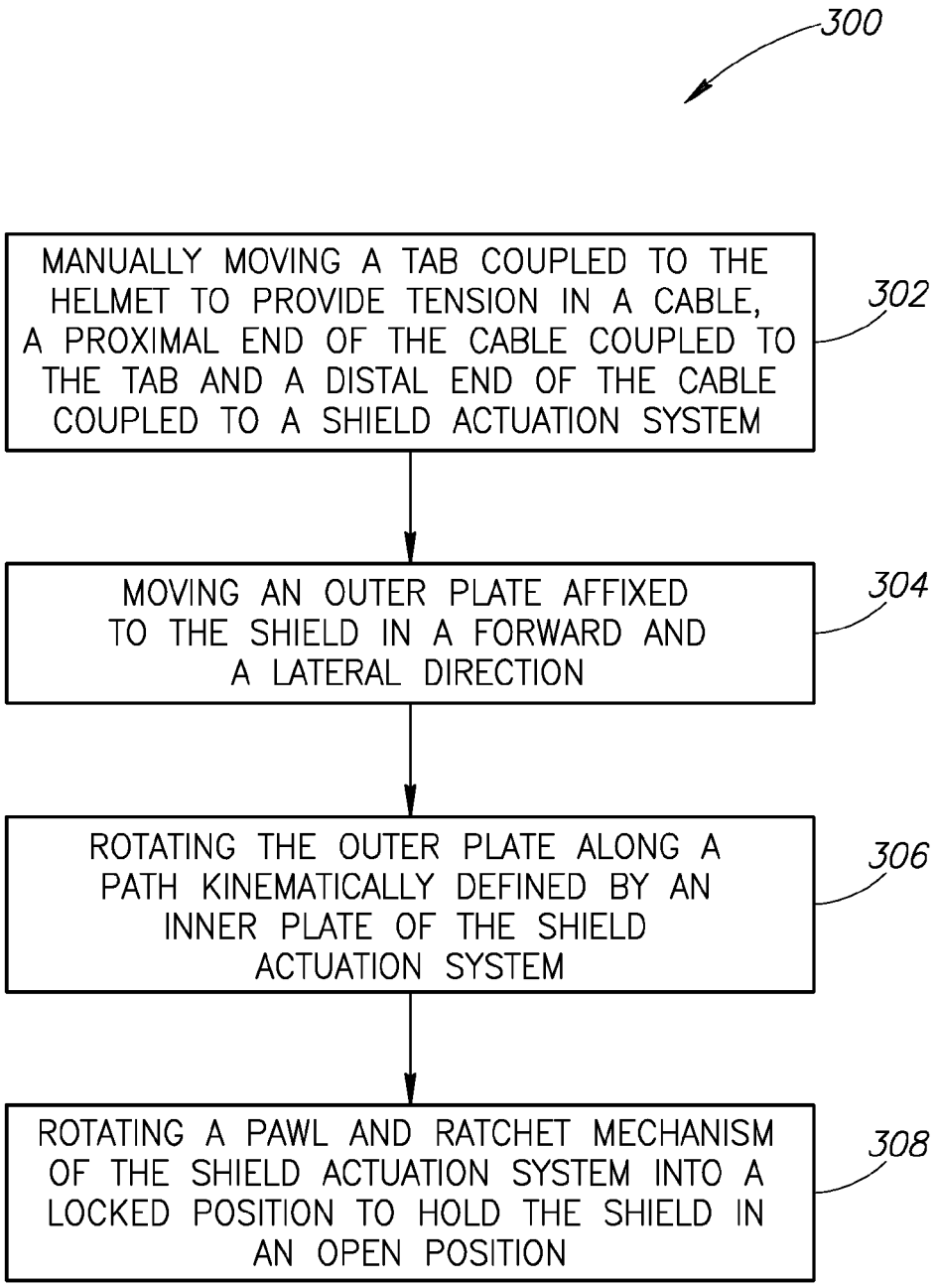
FIG. 17 is a flow diagram of a method for opening and closing a shield of a helmet according to an embodiment of the present invention.

FIG. 17 is a flowchart 300 of the operation of the shield actuation system 106 according to an embodiment of the invention. Continued reference to FIGS. 12A-16C may be helpful in following the mechanical actuation process of the shield actuation system 106. At Step 302, the shield 104 is in the closed position and a wearer of the helmet 100 begins the opening process by manually moving the push member or tab 108 to provide tension in the cable 111. One end of the cable 111 is coupled to the push member 108 and an opposite or distal end of the cable 111 is coupled to the pawl pin 188 of the shield actuation system 106. The tension in the cable 111 rotates the pawl 182, which in turn causes the finger 190 to rotate the ratchet member 184 in a first rotational direction about ratchet pivot 192. At Step 304, rotation of the ratchet member 184 causes the top-pin driver 200 to push the top pin 140 of the outer plate 112 in a forward direction. In turn, the top pin 140 moves forward within top inner slot 160 of the inner plate 122 and thus urges the intermediate plate 124 forward. Simultaneously, movement of the intermediate plate 124 relative to the inner plate 122 is kinematically constrained by the angled slots 154, which in turn forces the intermediate plate 124 to move not only forward, but also outward (i.e., pop out). The outer plate 112 and the shield 104 also pop out in accordance with the movement of the intermediate plate 124.

At Step 306 and with both the intermediate plate 124 and outer plate 112 popped laterally outward and moved forward, the outer plate 112 has popped out far enough to clear the intermediate plate 124 when the outer plate 112 is rotated. By way of example, the wearer may manually rotate the shield 104 upward relative to the shell 102. In turn, the outer plate 112, affixed to the shield 104, rotates along a path kinematically defined, at least in part, by the inner plate 122. In particular, the rotation of the shield 104 and the outer plate 112 coupler are determined by the engagement of the various pins extending from the outer plate 112 as received by the contoured slots formed in the inner plate 122. At Step 308, the pawl and ratchet mechanism 138 is moved a locked configuration to hold the shield in an open position. Preferably, the locked configuration occurs when pawl finger 190 of the pawl 182 engages finger-notch 198 of the ratchet 184.

The shield actuation system described above advantageously provides a thin structural profile seated within a recess of the shell without having to reduce the structural and safety aspects of the shell locally surrounding the shield actuation system. Further, the shield actuation system permits the shield to be substantially flush with the shell when in the closed position. The shield actuation system allows for easy and repeated movement of the shield with minimal effort from the wearer of the helmet.

Many other changes can be made in light of the above detailed description. In general, in the following claims, the terms used should not be construed to limit the invention to the specific embodiments disclosed in the specification and the claims, but should be construed to include all types of safety helmets, actuation systems, and shields or visors that operate in accordance with the claims. Accordingly, the invention is not limited by the disclosure, but instead its scope is to be determined entirely by the following claims.

What is claimed is:

1. A helmet comprising:

a shell having an external shell surface;

a shield having an external shield surface, the shield movable from a closed position to an open position relative to the shell, the shield surface aligned substantially flush with the adjacent shell surface when the shield is in the closed position; and a shield actuation system having:

an inner plate fixed to the shell;

an outer plate positioned on the shield; and an intermediate plate located between the inner plate and the outer plate, the intermediate plate being secured to the inner plate via a plurality of pins retained within a plurality of slots, the pins being slideable within the slots to enable movement of the intermediate plate with respect to the inner plate between a first position in which the intermediate plate is closely adjacent the inner plate and a second position in which the entire intermediate plate is moved laterally outward from the inner plate;

the outer plate further having a perimeter defining an interior space and being pivotally connected to the intermediate plate for rotation of the perimeter of the outer plate about a pivot point located within the interior space of the outer plate, whereby the outer plate defines an outer plate plane and the intermediate plate defines an intermediate plate plane, the outer plate plane being substantially parallel to the intermediate plate when the shield is in both the open position and the closed position;

whereby actuation of the shield actuation system when the shield is in the closed position causes the intermediate plate to move to the second position and enables the outer plate to rotate with respect to the intermediate plate to move the shield to the open position.

2. The helmet of claim 1, wherein the plurality of slots are formed in the inner plate and the plurality of pins are formed on opposing sides of the intermediate plate, the slots being configured to receive corresponding pins extending from the intermediate plate.

3. The helmet of claim 1, further comprising a pawl and ratchet mechanism configured to lock the outer plate in situ relative to the intermediate plate when the shield is in the closed position.

4. The helmet of claim 1, wherein the outer plate further comprises a plurality of pegs received within a corresponding plurality of curved channels formed in the intermediate plate, the curved channels defining a path of travel of the pegs within the curved channels, and thereby further defining a corresponding path of rotation of the outer plate when the shield is moved between the open position and the closed position.

5. The helmet of claim 1, further comprising:

a lever coupled to a face guard portion of the shell; and a cable having a first end coupled to the lever and a second end operatively coupled to the shield actuation system.

6. The helmet of claim 1, wherein the intermediate plate moves outward and forward by an amount that permits the outer plate to clear the surface of shell when the shield is rotated, the direction and distance of travel of the intermediate plate being defined by the length of the plurality of slots, and further wherein the plurality of slots are further positioned to be parallel to one another.

7. The helmet of claim 1, wherein the outer plate is slideably coupled to the shield.

8. The helmet of claim 1, wherein the inner and intermediate plates define a cavity for housing a pawl and ratchet mechanism.

9. The helmet of claim 8, further comprising at least one biasing member engaged with the pawl and ratchet mechanism.

10. The helmet of claim 1, wherein the outer plate further comprises a central pin received within a curved channel formed in the intermediate plate, the curved channel defining a path of travel of the central pin within the curved channel, and thereby further defining a corresponding rotation of the outer plate when the shield is moved between the open position and the closed position.

11. A helmet comprising:

a shell having an external shell surface;

a shield having an external shield surface, the shield movable from a closed position to an open position relative to the shell, the shield surface aligned substantially flush with the adjacent shell surface when the shield is in the closed position; and a shield actuation system seated in a recess of the shell and the shield rotationally coupled to the actuation system, the system comprising:

a cable manually tensionable, a distal end of the cable coupled to the shield actuation system;

a pawl and ratchet mechanism rotatable by tension generated in the cable;

a first member fixed to the shell, the first member having angled slots;

a second member movable in a forward direction by the pawl and ratchet mechanism and having a plurality of pins trained within the angled slots, the second member being guided in an outward direction by the angled slots of the first member;

a third member attached to the shield, the third member being rotatable with respect to the second member along a path of travel defined by a plurality of pins and a corresponding plurality of arcuate channels retaining a respective one of the plurality of pins;

whereby when the shield is moved from a closed position to an open position the second member is moved laterally away from the first member and the third member is rotated with respect to the second member.

12. The helmet of claim 11, wherein the first and second members includes a plurality of guide slots.

13. The helmet of claim 11, wherein a driver of the pawl and ratchet mechanism operates to move the second and third members in the forward direction.

14. The helmet of claim 11, wherein the cable is directly coupled to a pawl of the pawl and ratchet mechanism, wherein rotation of the pawl generates rotation of a ratchet of the pawl and ratchet, and wherein a driver extending from the ratchet moves a pin of the third member in the forward direction.

15. The helmet of claim 11, further comprising a finger-actuatable lever positioned on the shell and coupled to the cable, wherein movement of the lever generates tension in the cable.

* * * * *